United States Patent [19]

Cataldo

[11] 3,981,519

[45] Sept. 21, 1976

[54] RESTRAINT BELT BUCKLE ASSEMBLY

[75] Inventor: Roy S. Cataldo, Birmingham, Mich.

[73] Assignee: General Motors Corporation, Detroit, Mich.

[22] Filed: July 28, 1975

[21] Appl. No.: 599,855

[52] U.S. Cl. ..... 280/744; 24/230 AT

[51] Int. Cl.[2] ..... B62B 35/00

[58] Field of Search ..... 280/150 SB; 297/385, 297/386, 387, 388, 389; 24/230 AT, 211 M, 110

[56] References Cited

UNITED STATES PATENTS

| | | | |
|---|---|---|---|
| 2,902,737 | 9/1959 | Moran | 24/230 AT |
| 3,146,846 | 9/1964 | Gutshall | 280/150 SB |
| 3,249,328 | 5/1966 | Knowles | 24/230 AT |
| 3,907,361 | 9/1975 | Lehmann | 280/150 SB |

*Primary Examiner*—Robert R. Song
*Attorney, Agent, or Firm*—C. E. Leahy

[57] ABSTRACT

A seat belt buckle assembly includes a male buckle member attached to a length of belt for movement with the belt and a female latch member mounted on a member of the vehicle body. The male buckle member is provided on the seat belt and has a round cylindrical pintle attached to a buckle member housing. A plunger is telescopically mounted inside the pintle and is normally retracted therein by a spring. An occupant actuatable device in the form of a push-button and linkage is provided in the buckle member housing for selectively moving the plunger from the normal retracted position to an extended position. The female latch member has a round cylindrical opening in the housing thereof for receiving the pintle of the buckle member at any degree of orientation of the pintle about its axis. A pair of latch plates are pivotally mounted in the latch member housing at diametrically opposed positions relative the round cylindrical opening. The pintle has a circumferentially extending groove defining a shoulder which is engaged by the pair of latch plates to retain the male buckle member in the female latch member. A release lever is associated with each of the latch plates and is engageable by the plunger upon movement of the plunger to the extended position by the occupant actuatable means to disengage the latch plates from the shoulder of the pintle. Since the release push-button of the buckle arrangement is carried by the male buckle member mounted on the belt, the female buckle member may be recessed in flush relationship with the seat cushion or other member of the vehicle body.

3 Claims, 5 Drawing Figures

RESTRAINT BELT BUCKLE ASSEMBLY

The invention relates to a seat belt buckle.

A conventional buckle arrangement for a vehicle seat belt includes a male latch plate which is inserted into a mating elongated slot in a female buckle member. The female buckle member includes a spring biased lock member having a tang which is lockingly engaged in an aperture of the male latch plate. A push-button operator is provided on the female buckle member to disengage the tang of the lock member from the aperture of the latch plate.

It is characteristic of conventional buckles of the aforedescribed type that in order to effect locking of the buckle arrangement the seat occupant must align the longitudinal axis of the male and female portions of the buckle so that the male latch plate can be inserted into the mating elongated slot of the female buckle member. Another feature of the aforedescribed conventional belt buckle arrangement is that the female buckle member does not lend itself to being mounted in flush relationship with a seat cushion or other member of the vehicle body since the push-button operator must be readily accessible to the occupant.

According to the present invention, a male buckle member is provided on the seat belt and has a round cylindrical pintle attached to a buckle member housing. A plunger is telescopically mounted inside the pintle and is normally retracted therein by a spring. An occupant actuatable device in the form of a push-button and linkage is provided in the buckle member housing for selectively moving the plunger from the normal retracted position to an extended position. The female latch member has a round cylindrical opening in the housing thereof for receiving the pintle of the buckle member at any degree of orientation of the pintle about its axis. A pair of latch plates are pivotally mounted in the latch member housing at diametrically opposed positions relative the round cylindrical opening. The pintle has a circumferentially extending groove defining a shoulder which is engaged by the pair of latch plates to retain the male buckle member in the female latch member. A release lever is associated with each of the latch plates and is engageable by the plunger upon movement of the plunger to the extended position by the occupant actuatable means to disengage the latch plates from the shoulder of the pintle. Since the release push-button of the buckle arrangement is carried by the male buckle member mounted on the belt, the female buckle member may be recessed in flush relationship with the seat cushion or other member of the vehicle body.

Thus, the present invention features a seat belt buckle arrangement in which one-handed engagement of the seat belt buckle is facilitated by providing a buckle member and a latch member which are engageable irrespective of their relative axial orientation. Furthermore, the present invention features a buckle arrangement in which the release button is mounted on the male member so that the female member can be mounted in flush relationship with the seat cushion or other member of the vehicle body.

These and other features, objects and advantages of the invention will become apparent upon consideration of the specification and the appended drawings in which.

Figure 1:
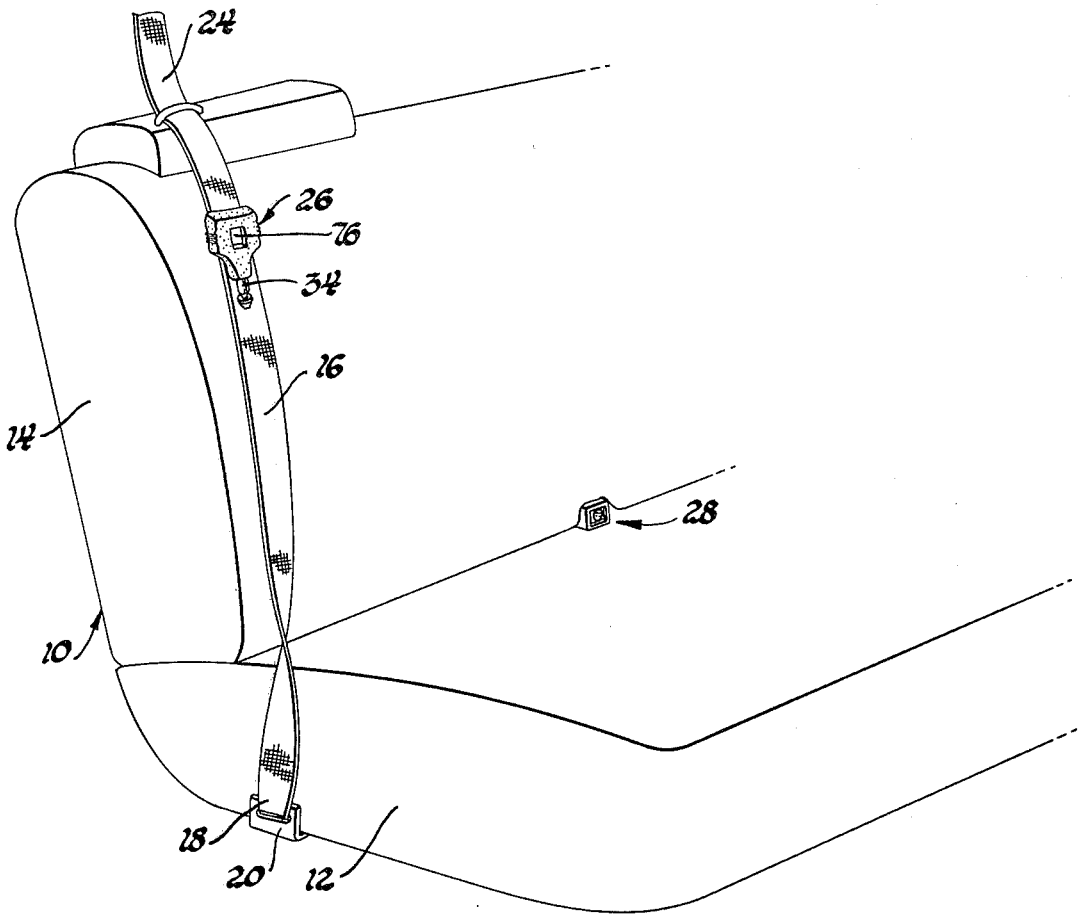
FIG. 1 is a perspective view of a vehicle seat having an occupant restraint belt system.

Referring to FIG. 1, a vehicle seat 10 is shown and includes a seat cushion 12 mounted on the vehicle floor and a seat back 14. A seat belt 16 has its lower end 18 anchored to the vehicle floor by a bracket 20. The upper end 24 of the belt 16 is mounted to the vehicle body by a roof mounted retractor, not shown.

A male buckle member 26 is slidable on the belt 16 intermediate the ends 18 and 24. A female latch member 28 is attached to the vehicle body or the vehicle seat by a short length of belt. The female latch member 28 may be mounted flush with the face of one of the cushions in the crevice between the seat cushion and seat back 14, as shown in FIG. 1.

Figure 2:
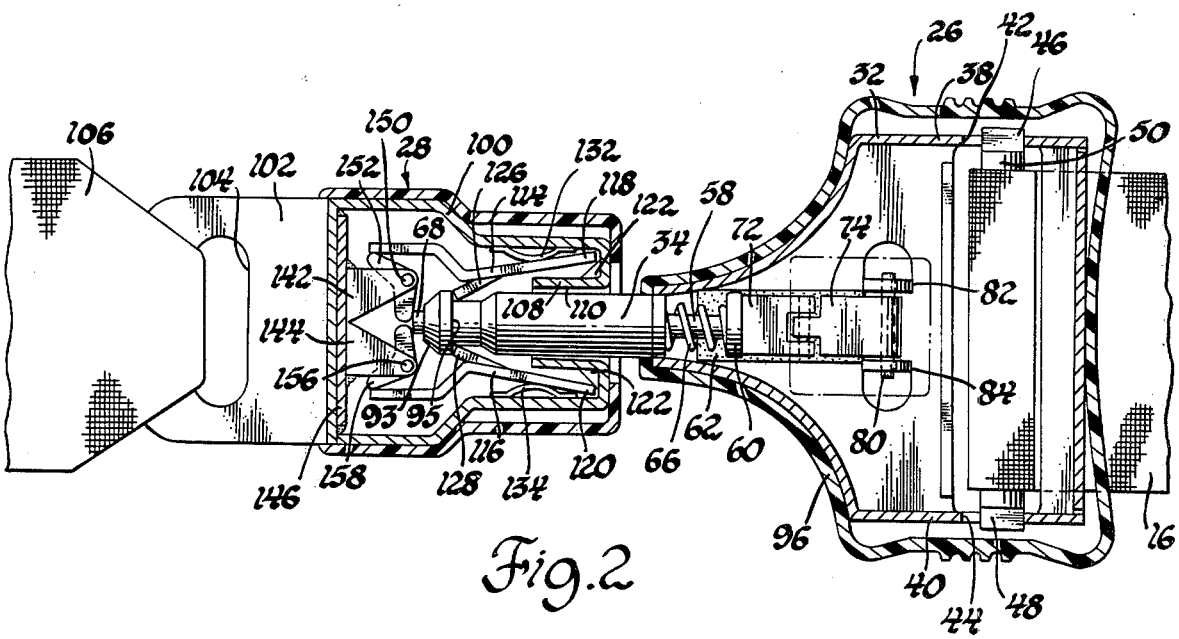
FIG. 2 is a plan view of a seat belt buckle in latched position and having parts broken away in sections.
Figure 4:
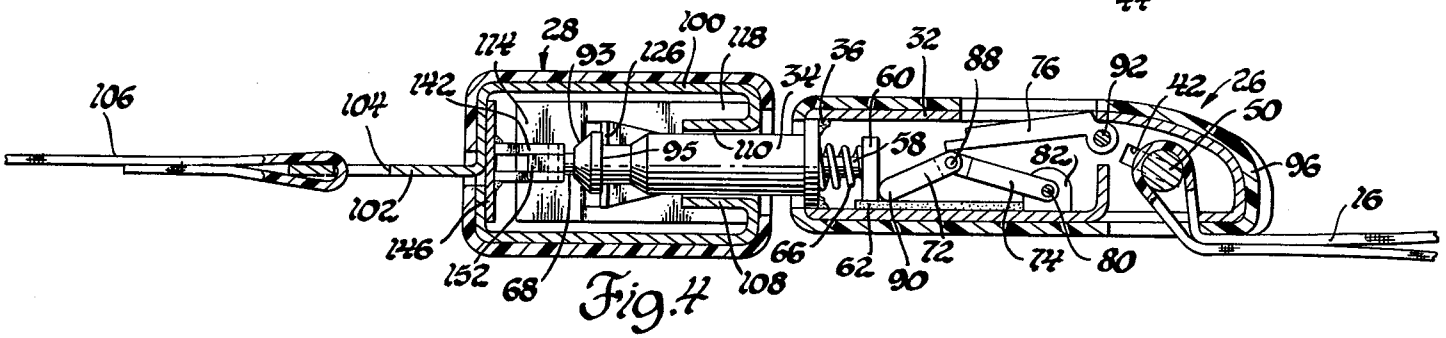
FIG. 4 is an elevation view corresponding to FIG. 3.

As best seen in FIGS. 2 and 4, the buckle member 26 includes a stamped metal buckle housing 32 having a round cylindrical pintle 34 attached to the housing 32 as by welding at 36. Laterally spaced upstanding side walls 38 and 40 at the end of the buckle housing 32 opposite the pintle 34 have angled slots 42 and 44 which slidably mount the flattened ends 46 and 48 of a round bar 50. The belt 16 encircles the bar 50 to divide the belt 16 into the lap belt and shoulder belt portions.

Figure 3:
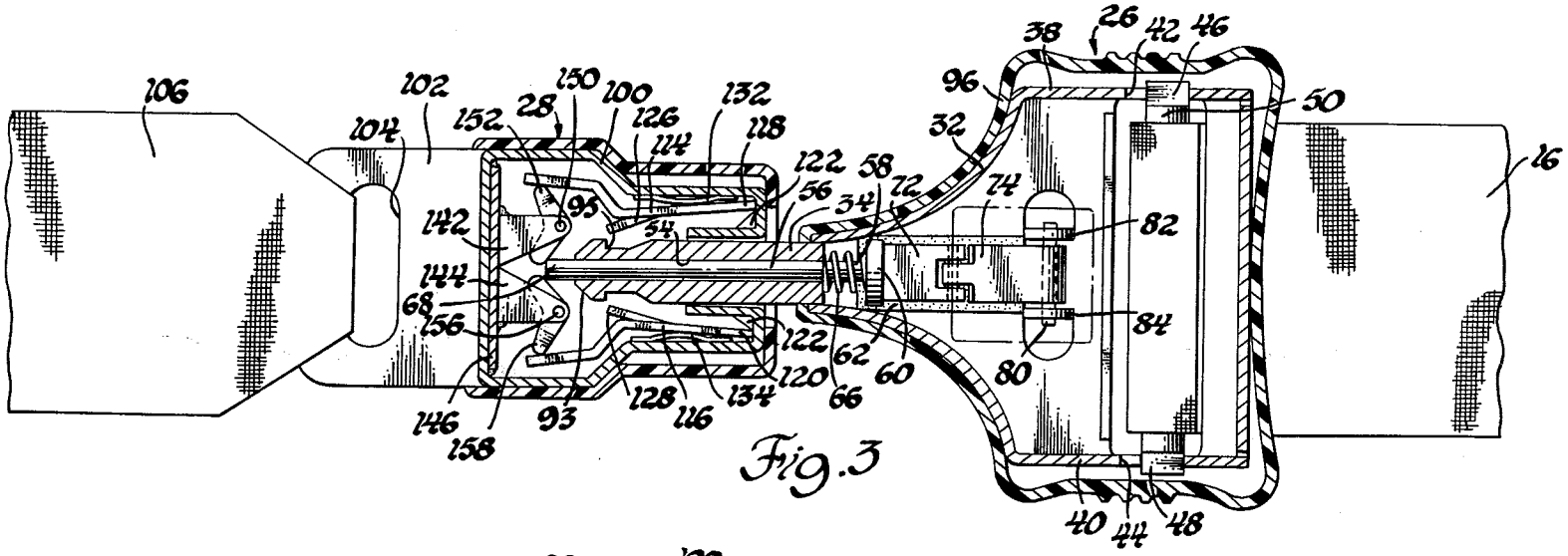
FIG. 3 is a view similar to FIG. 2 but showing the buckle assembly in unlatched position and poised for disengagement.
Figure 5:
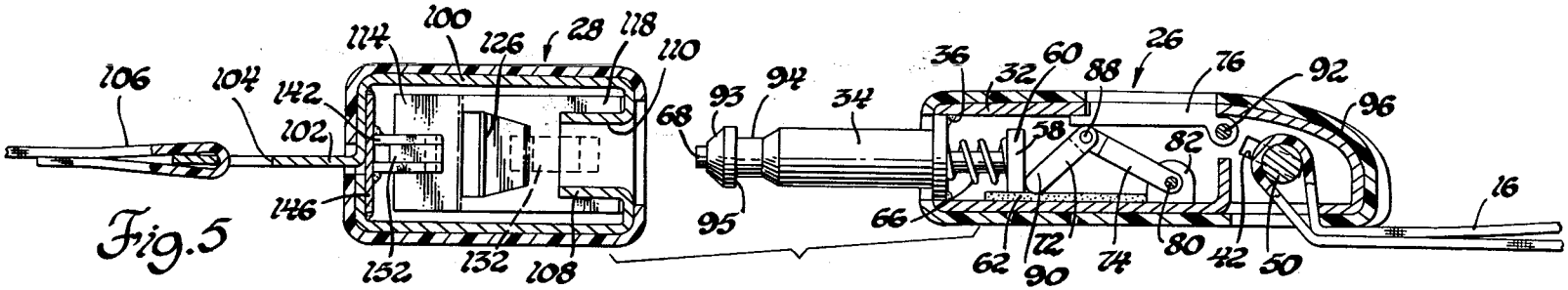
FIG. 5 is a side elevation view having parts broken away in sections and showing the seat belt buckle assembly disengaged.

As best seen in FIG. 3, the pintle 34 has an axial bore 54 in which a plunger 56 is telescopically slidable. The inner end 58 of the plunger 56 extends into the housing 32 and has a plate 60 attached thereto which slidably rides on a wear plate 62 attached to the buckle housing 32. A coil compression spring 66 acts between the plate 60 and the inner end of pintle 34 to bias the plunger 56 in the direction causing its outer end 68 to be retracted inside of pintle 34 as shown in FIGS. 2 and 4. The plunger 56 is movable from its retracted position of FIGS. 2 and 4 by an occupant actuatable means on the buckle housing 32 which includes a pair of links 72 and 74 and a release button 76. The link 74 is pivoted to the buckle housing 32 by a pivot shaft 80 extending between upstanding tangs 82 and 84 of the buckle housing 32. A pivot shaft 88 connects the other end of link 74 with one end of link 72. The free end 90 of link 72 bears slidably against the wear plate 62 and the plate 60 on the end of plunger 56. The release button 76 is pivoted to the buckle housing 32 by a pivot shaft 92 which extends between the laterally spaced upstanding walls 38 and 40 of the buckle housing 32. The other end of the release button 76 bears on the links 72 and 74 at the point of their juncture by the pivot shaft 88. Referring to FIGS. 4 and 5, it will be seen that when the occupant pivots release button 76 about its pivot shaft 92 the links 72 and 74 move the plunger 56 to an extended position in which its outer end 68 extends from the end of pintle 34. The outer end of pintle 34 is tapered at 93 and has a circumferentially extending groove 94 defining a shoulder 95 for purposes which will be discussed hereinafter. A plastic housing cover 96 is provided to cover the buckle housing 32.

Referring to FIGS. 2 and 5, it will be seen that the female latch member 28 includes a stamped metal latch housing 100 having a plate portion 102 extending from the end thereof and defining an elongated slot 104 through which the short length of belt 106 is received to anchor the latch housing 100 to the vehicle body or the vehicle seat as shown in FIG. 1. The latch housing 100 includes a round cylindrical wall portion 108 which defines a round cylindrical opening 110 for receiving the pintle 34.

A latch device is provided inside the latch housing 100 for lockingly engaging the pintle 34 to retain the pintle in the latch member 28. As best seen in FIG. 2, a pair of latch plates 114 and 116 are pivotally mounted in the latch housing 100 at diametrically opposed points relative the round cylindrical opening 110. The respective ends 118 and 120 of the latch plates 114 and 116 are engaged between a wall of the latch member 100 and an abutment 122. Integral latch tangs 126 and 128 are struck from the latch plates 114 and 116 intermediate their ends and are lockingly engageable against the shoulder 95 defined by the circumferentially extending groove 94 of the pintle 34 to retain the pintle 34 in the latch member 28. Leaf springs 132 and 134 act respectively between the latch housing 100 and the respective latch 114 and 116.

As best seen in FIGS. 2 and 4, a pair of clevises 142 and 144 are attached as by welding to a base plate 146 which is in turn welded to the latch housing 100. Clevis 142 includes spaced upper and lower plates having a pivot pin 150 extending therebetween to mount an L-shaped release lever 152 which acts between the outer end 68 and the plunger 56 and the end of latch plate 114. Clevis 144 has a similar pivot pin 156 which pivotally mounts a release lever 158 acting between the inner end 58 of plunger 56 and latch plate 116.

In operation, FIG. 2 shows the buckle member 26 and latch member 28 joined together to position the belt 16 in restraining position about the seated occupant. The pintle 34 is received in the round cylindrical opening 110 of the latch member 28. Leaf springs 132 and 134 bias the latch plates 114 and 116 inwardly so that their respective latch tangs 126 and 128 ride over the taper at 93 and are engaged against the shoulder 95 provided by the circumferentially extending groove 94. The latch levers 114 and 116 are effective to receive and retain the pintle 34 irrespective of the orientation of the buckle member 26 relative the latch member 28. In this manner, buckling of the seat belt is facilitated since there is no necessity for the seated occupant to align the axis of the buckle member 26 with the axis of the aperture of the latch member 28.

Referring to FIGS. 3 and 4, the seat occupant may effect release of the buckle member 26 from the latch member 28 by depressing the release button 76. As seen in FIG. 4, the release button 76 is pivoted about its pivot shaft 92 causing the link 72 to act against the plate 60 and thereby slide the plunger 56 outwardly of the bore 54 in pintle 34. The outer end 68 of plunger 56 is thereby extended outwardly and pivots the release levers 152 and 158 to respectively urge the latch plates 114 and 116 to their positions of FIG. 3 in which the latch tangs 126 and 128 are withdrawn from the circumferentially extending groove 94 of the pintle 34. The buckle member 26 and its pintle 34 may then be withdrawn from the latch member 28 to complete the disengagement of the buckle and permit movement of the belt 16 to its stored position of FIG. 1.

What is claimed is:

1. In a seat belt assembly having a buckle member attached to a length of seat belt for movement with the belt between restraining and stored positions and a latch member mounted on a member of the vehicle body, the combination comprising: the buckle member having a buckle member housing, a round cylindrical pintle attached to the buckle member housing and having an end projecting therefrom, a plunger telescopically mounted inside the pintle and having a normal retracted position inside the end of the pintle, occupant actuatable means on the buckle member housing for selectively moving the plunger from the normal retracted position to an extended position, the latch member having a latch member housing with a round cylindrical opening for receiving the pintle of the buckle member at any degree of orientation of the pintle about its axis, latch means carried by the latch member housing and lockingly engageable with the pintle to retain the pintle in the latch member, and release means in the latch member being actuated upon movement of the plunger to the extended position by the occupant actuatable means to disengage the latch means from locking engagement of the pintle.

2. In a seat belt assembly having a buckle member attached to a length of seat belt for movement with the belt between restraining and stored positions and a latch member mounted on a member of the vehicle body, the combination comprising: the buckle member having a buckle member housing, a round cylindrical pintle attached to the buckle member housing and having an end projecting therefrom, a plunger telescopically mounted inside the pintle and having a normal retracted position inside the end of the pintle, a circumferentially extending groove forming a shoulder on the end of the pintle, occupant actuatable means on the buckle member housing for selectively moving the plunger from the normal retracted position to an extended position, the latch member having a latch member housing with a round cylindrical opening for receiving the pintle of the buckle member at any degree of orientation of the pintle about its axis, a pair of latch plates pivotally mounted in the latch member housing and disposed at diametrically opposed positions relative the round cylindrical opening, spring means acting between the latch member housing and each of the latch plates to urge the latch plates into engagement of the shoulder of the pintle, a release lever associated with each latch plate and being pivotally mounted on the latch member housing, the release levers being engaged by the plunger upon movement of the plunger to the extended position by the occupant actuatable means to pivot the latch plates against the bias of the spring means to disengage the latch plates from the shoulder of the pintle thereby releasing the buckle member from the latch member.

3. In a seat belt assembly having a buckle member attached to a length of a seat belt for movement with the belt between restraining and stored positions and a latch member mounted on a member of the vehicle body, the combination comprising: the buckle member having a buckle member housing, a round cylindrical pintle attached to the buckle member housing and having an end projecting therefrom, a plunger telescopically mounted in the pintle, a release button movably mounted on the buckle member housing, linkage means acting between the push-button and the plunger, spring means acting on the plunger to retract the plunger inside the end of the pintle and causing the plunger to act through the linkage means to hold the push-button in a normal unactuated position, actuation of the push-button acting through the linkage means to move the plunger against the bias of the spring means to an extended position in which the plunger projects from the end of the pintle, the latch member having a latch member housing with a round cylindrical opening for receiving the pintle of the buckle member at any degree of orientation of the pintle about its axis, latch means carried by the latch member housing and lockingly engageable with the pintle to retain the pintle in the latch member, and release means in the latch member being actuated upon movement of the plunger to the extended position by actuation of the push-button to disengage the latch means from locking engagement of the pintle of the buckle member.

* * * * *